US008701278B2

(12) United States Patent
Merical

(10) Patent No.: US 8,701,278 B2
(45) Date of Patent: Apr. 22, 2014

(54) METHOD FOR ATTACHING A CONNECTOR TO A PREPARED COAXIAL CABLE

(75) Inventor: Edward L. Merical, Canal Fulton, OH (US)

(73) Assignee: PDS Electronics, Inc., Tallmadge, OH (US)

( * ) Notice: Subject to any disclaimer, the term of this patent is extended or adjusted under 35 U.S.C. 154(b) by 143 days.

(21) Appl. No.: 12/932,049

(22) Filed: Feb. 17, 2011

(65) Prior Publication Data

US 2011/0138623 A1 Jun. 16, 2011

Related U.S. Application Data

(62) Division of application No. 12/151,441, filed on May 8, 2008, now abandoned.

(51) Int. Cl.
*H01B 13/20* (2006.01)

(52) U.S. Cl.
USPC ..... 29/828; 29/867; 29/868; 439/585

(58) Field of Classification Search
USPC ..... 29/828, 884, 876, 857, 868, 729, 739; 439/584–587; 174/75 C, 84 R
See application file for complete search history.

(56) References Cited

U.S. PATENT DOCUMENTS

| | | | | |
|---|---|---|---|---|
| 3,701,086 | A * | 10/1972 | Somerset | 439/580 |
| 4,317,279 | A | 3/1982 | Smith et al. | 30/90.1 |
| 5,515,571 | A | 5/1996 | Grande | 15/220.4 |
| 5,802,710 | A * | 9/1998 | Bufanda et al. | 29/828 |
| 5,888,094 | A | 3/1999 | Kubota et al. | 439/583 |
| 5,980,317 | A * | 11/1999 | McNeel | 439/589 |
| 6,123,567 | A * | 9/2000 | McCarthy | 439/427 |
| 6,592,403 | B2 * | 7/2003 | Kooiman | 439/578 |
| 6,640,439 | B2 | 11/2003 | Losinger | 30/90.2 |
| 6,870,107 | B2 | 3/2005 | Daume | 174/74 R |
| 7,264,503 | B2 * | 9/2007 | Montena | 439/587 |
| 7,270,506 | B2 | 9/2007 | Guy | 409/234 |
| 7,694,420 | B2 | 4/2010 | Ehret et al. | 30/90.1 |
| 7,972,176 | B2 * | 7/2011 | Burris et al. | 439/584 |
| 8,479,383 | B2 * | 7/2013 | Van Swearingen et al. | 29/828 |
| 2004/0082218 | A1 * | 4/2004 | Stirling | 439/587 |

* cited by examiner

*Primary Examiner* — Minh Trinh
(74) *Attorney, Agent, or Firm* — Fay Sharpe LLP

(57) ABSTRACT

A device is provided to attach a connector having an internally threaded base and external threads to a cable having a casing. The device includes a body having a bore therethrough. At least a portion of the bore is threaded and the external threads on the connector are threaded into the threads of the bore until a stop surface in the bore is engaged by a portion of the connector. The device may then be turned to thread the base onto the casing of the cable.

10 Claims, 4 Drawing Sheets

METHOD FOR ATTACHING A CONNECTOR TO A PREPARED COAXIAL CABLE

CROSS-REFERENCE TO RELATED APPLICATION

This application is a division of U.S. patent application Ser. No. 12/151,441 which was filed on May 8, 2008 now abandoned.

TECHNICAL FIELD

This invention relates to a device which is used for a method to attach electrical connections to a coaxial cable.

BACKGROUND ART

Attaching electrical connectors to a coaxial cable has always been a tedious task. Typical of such connectors are those known as PL-259 UHF connectors or Type N connectors. These connectors have an internally threaded body which must be attached to the outside casing, which is usually made of rubber or a like material, of a coaxial cable. To effect the attachment, the body of the connector is placed adjacent to the casing and must some how be grasped by the user and turned to actually cut threads into the casing material. Usually, a tool is used to grab and turn the connector. However, care must be taken because the tool could well damage the connector. Alternatively, one could try to turn the connector by hand, but the process is not only tiring but also can be harmful to the hand of the user because cutting the threads in the casing requires a great deal of force. Moreover, care must be taken so as not to thread the connector too far onto the cable because such could well damage the connector.

As a result, the need exists for a device which can be used to attach connectors to a cable with a minimal effort.

DISCLOSURE OF THE INVENTION

It is thus an object of one aspect of the present invention to provide a device which can be used to easily attach a connector to the end of a cable.

It is an object of another aspect of the present invention to provide a device, as above, which can indicate when the connector is properly connected to the cable.

It is an object of a further aspect of the present invention to provide a device, as above, which will not allow the connector to be over tightened onto the cable.

It is another object of the invention to provide a method of attaching a connector to the end of a cable.

These and other objects, of the present invention, as well as the advantages thereof over existing prior art forms, which will become apparent from the description to follow, are accomplished by the improvements hereinafter described and claimed.

In general, a device to attach a connector having an internally threaded base and external threads to a cable having a casing includes a body portion. The body portion has a bore with a threaded portion adapted to engage the external threads of the connector. A stop surface in the bore is adapted to engage the connector so that the connector cannot be further threaded into the bore. The device and the connector are rotatable to position the threaded base of the connector onto the casing of the cable.

In accordance with another aspect of the invention, the method of attaching a connector having an internally threaded base and external threads to a cable having a casing includes the step of threading the external threads into the threaded bore of a device until the connector engages a stop surface in the bore. The device, while carrying the connector, is then rotated to attach the internally threaded base of the connector to the casing.

A preferred exemplary device utilized in a method for attaching a connector to the end of a cable according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
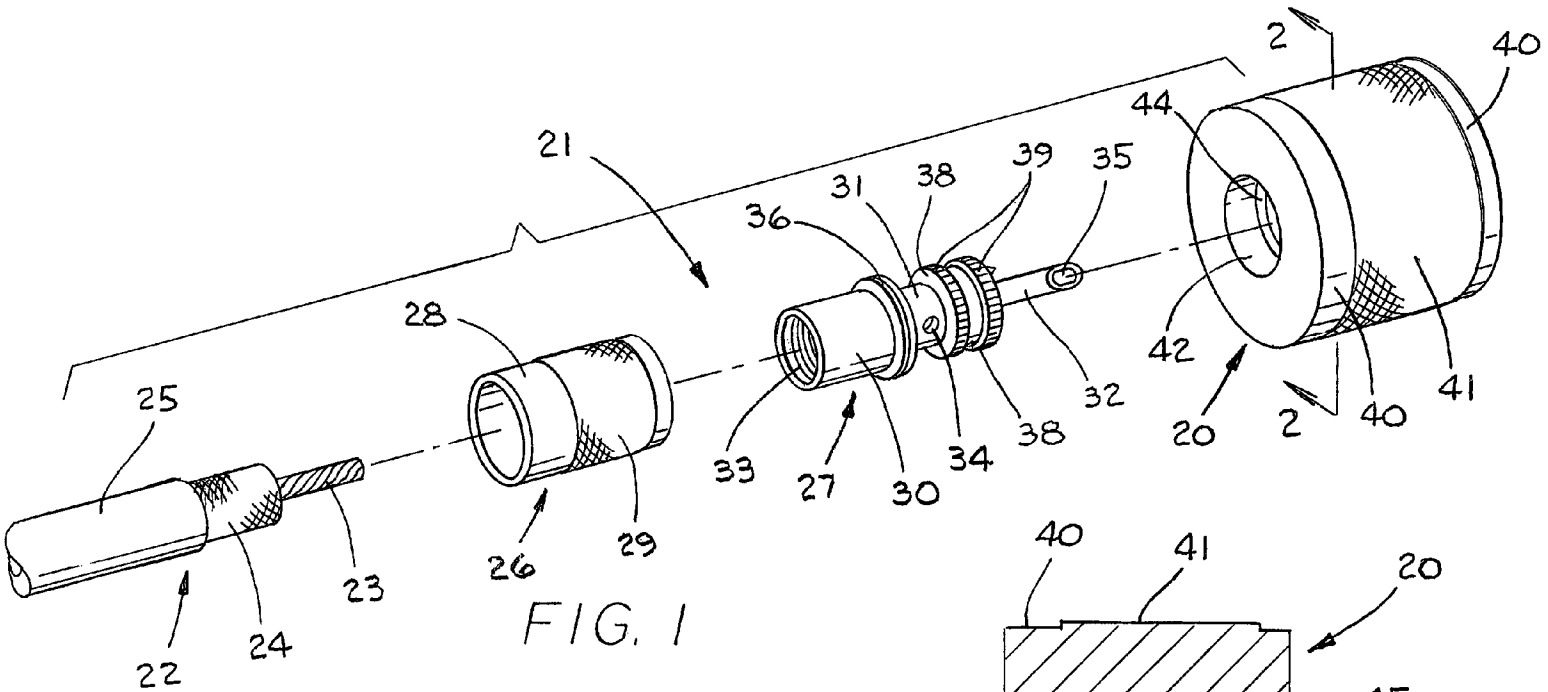
FIG. 1 is an exploded perspective view of a prepared cable, connector component, and a device made in accordance with the present invention which is used to attach the connector to the cable.
Figure 2:
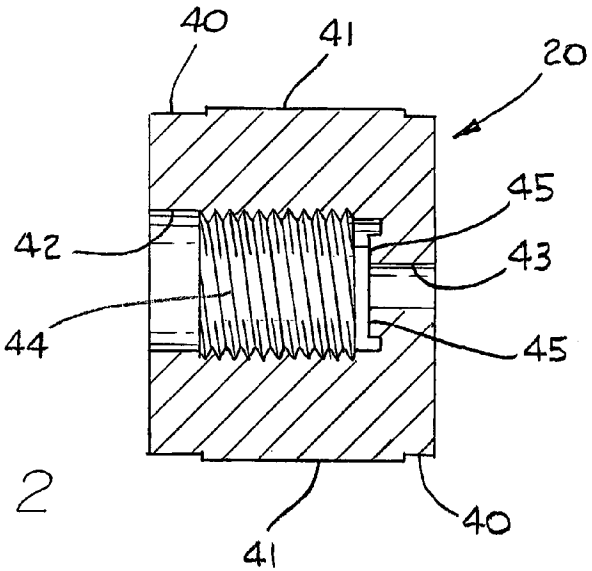
FIG. 2 is a sectional view of the device taken substantially along line 2-2 of FIG. 1.

A connector installation device according to the present invention is indicated generally by the numeral 20 in FIG. 1 and is used to assist in connection an electrical connector, generally indicated by the numeral 21, to a prepared coaxial cable generally indicated by the numeral 22.

Cables 22 are known in the art as having a central wire 23 and a wire sheath 24 spaced from wire 23. A plastic or other insulating sleeve (not shown) is positioned between wire 23 and sheath 24 to electrically isolate the same. Sheath 24 is covered by a durable casing 25 made of rubber or a like plastic or synthetic material.

The connector 21 shown in FIG. 1 is a conventional uhf connector, known in the art as a PL-259 connector, which includes a shell generally indicated by the numeral 26 and a connector body generally indicated by the numeral 27. Shell 26, which is sometimes known in the art as a barrel, is in the form of a hollow cylindrical tube 28 which can have an outer textured surface 29 for ease of gripping. Connector body 27 is hollow and includes a generally cylindrical base portion 30 of an internal diameter approximating the external diameter of cable casing 25; a cylindrical intermediate portion 31 communicating with the base portion 30 and having an internal diameter approximating the external diameter of the cable sheath 25, and a cylindrical tip portion 32 communicating with the intermediate portion 31 and having an internal diameter approximating the external diameter of the cable central with 23. The front face (not shown) of intermediate portion 31 is provided with a dielectric seal extending from the outer surface of tip portion 32 to the inside surface of intermediate portion 31. It is important that this seal not be broken as could often happen if connector body 27 were over tightened onto cable 22 by methods of the prior art.

The base portion 30 is provided with internal threads 33 which, as will hereinafter be described in more detail, are adapted to engage cable casing 25. Intermediate portion 31 is provided with a hole 34 so that when cable sheath 24 is positioned therein, sheath 24 may be soldered to connector body 27. Similarly, tip portion 32 has an open end 35 so that the cable wire 23 positioned in tip portion 32 and exposed at open end 35 may be soldered to tip portion 32.

Figure 4:
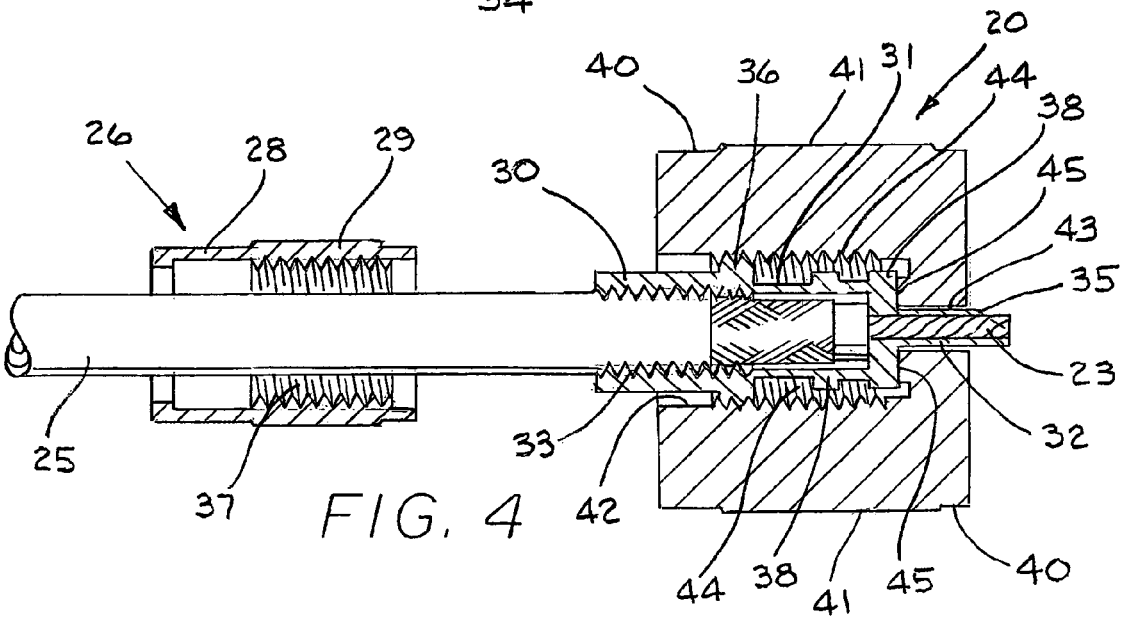
FIG. 4 is a view like FIG. 3 but showing the connector in section and attached to the cable.
Figure 5:
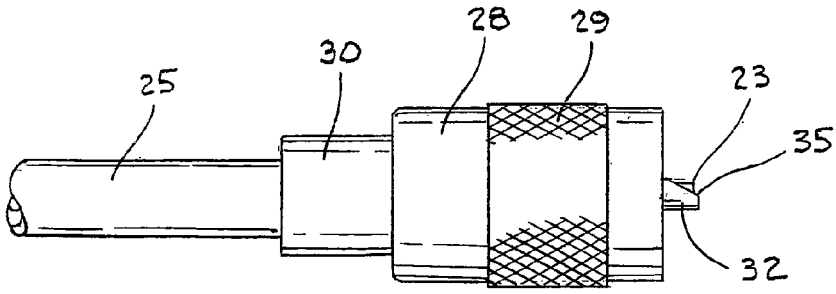
FIG. 5 is an elevational view of the connector on the cable.
Figure 6:
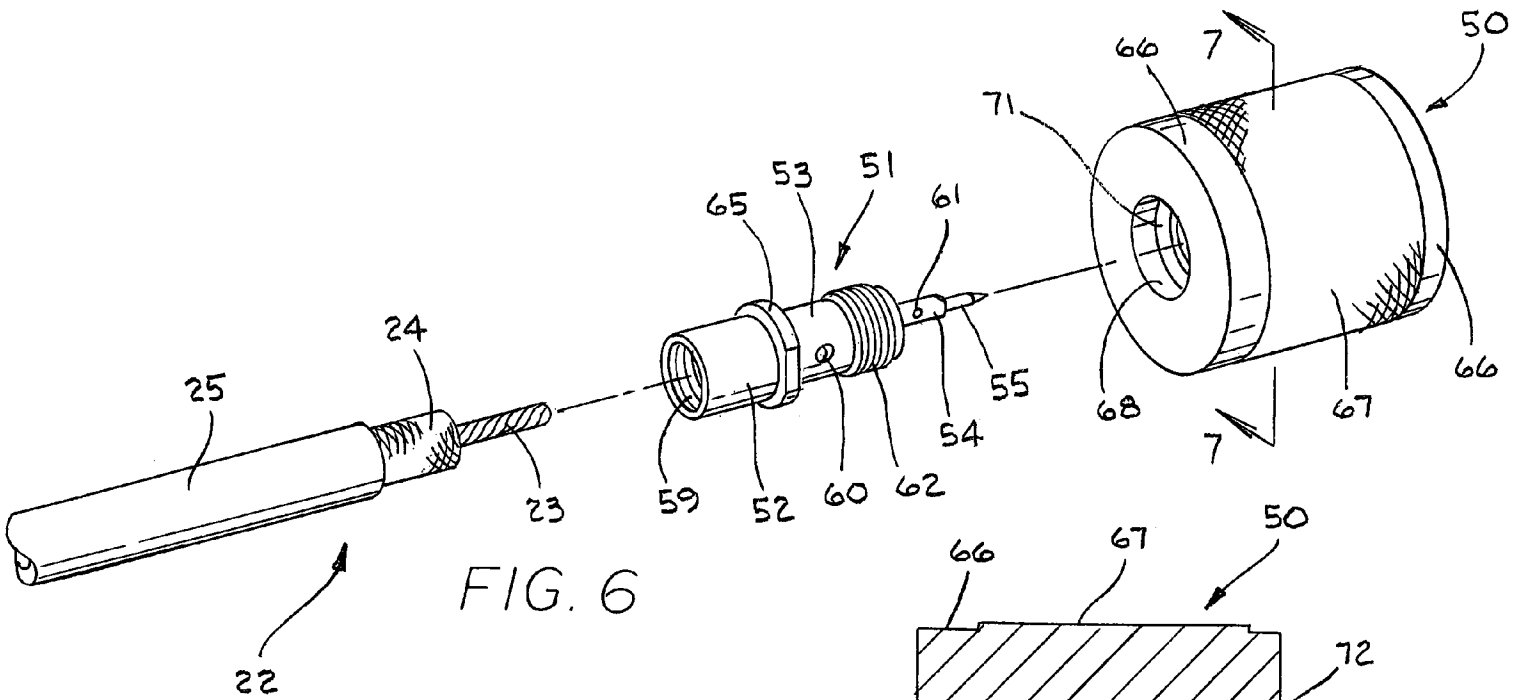
FIG. 6 is an exploded perspective view of a prepared cable, a different style connector component, and a modified device made in accordance with the present invention.
Figure 7:
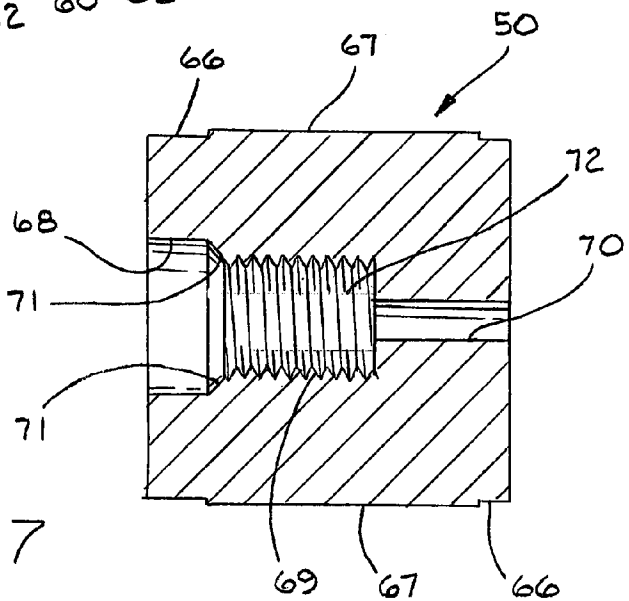
FIG. 7 is a sectional view of the modified device taken substantially along line 7-7 of FIG. 6.

The end of base portion 30 adjacent to intermediate portion 31 is provided with an externally threaded collar 36. Connector shell 26 is provided with internal threads 37 (FIG. 4) which may engage threaded collar 36 and be attached to connector body 27 as shown in FIG. 5. The intermediate portion 31 of connector body 27 is typically provided with flanges 38 having a knurled outer surface 39. In a conventional connector such as connector 21, flanges 38 can be gripped and connector body 27 turned to allow the threads 33 of base portion 30 to cut threads into the cable casing 25 to attach the connector body 27 to the casing 25. However, flanges 38 of a conventional connector are no longer necessary in view of the device 20 now to be described.

Connector installation device 20 can be made of a metallic material and is formed with a body having a generally cylindrical outer surface 40 at least a portion 41 of which may be textured for ease of gripping. The body of device 20 is provided with a generally axially extending bore therethrough having a section of first diameter 42 and a section of second diameter 43. At least a portion of the first diameter bore section 42 is provided with threads 44. A doughnut shaped stop surface 45 is located generally at the surface of bore sections 42 and 43 and extends around the second diameter bore section 43 and into axially the first diameter bore section 42.

Figure 3:
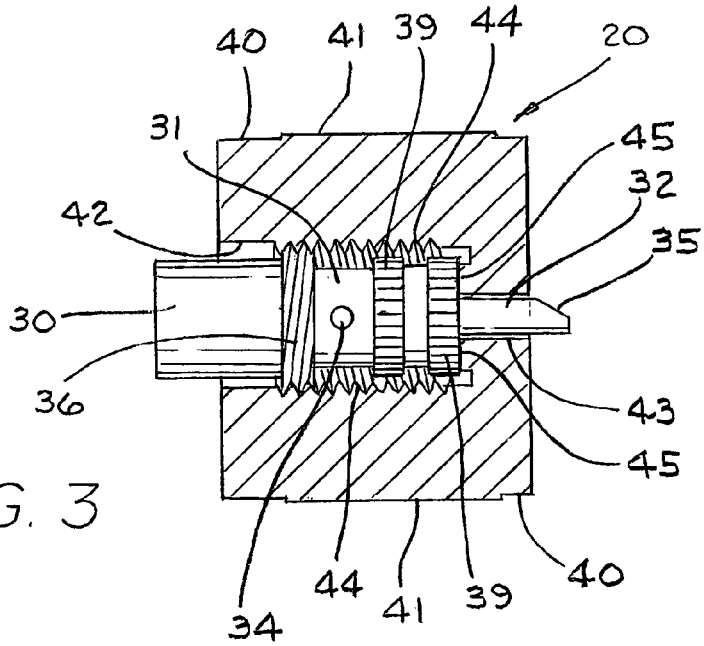
FIG. 3 is a view like FIG. 2 showing the connector in the device.

Installation device 20 is used very simply to attach a connector body 27 to an end of a cable 22. After shell 26 has been telescoped onto cable 22, cable 22 may be inserted into connector body 27 until threads 33 begin to engage caging 25. Connector body 27 is then inserted into the first diameter 42 end of the bore in device 20 and body 27 is attached to device 20 by the engagement of threads 36 and 44 via relative rotation of device 20 and body 27. Alternatively, connector body 27 may be threaded into device 20 before it is initially attached to cable 22. As shown in FIG. 3, body 27 is threaded into the bore until the axial end of intermediate portion 31, at outer flange 38, bottoms out and engages stop surface 45. At this point the end 35 of tip portion 32 extends through the second diameter 43 of the bore and thus extends out of the body of device 20. The connector body 27 is now ready and in position to be attached to the casing 25 of cable 22, as now to be described.

With connector body 27 positioned as shown in FIG. 3, the textured portion 41 of the body of installation device 20 is preferably gripped by the user and then the end of cable 22 is inserted into the mouth of the hollow base portion 30 of body 27. If connector body 27 has not already been loosely attached to cable 22, as previously described, cable 22 may be held steady and device 20 may be rotated while urging it toward cable 22. Continued rotation causes the threads 33 of base portion 30 to cut threads into, and thus fully engage, casing 25 of cable 22. Rotation of device 20 continues until wire 23 appears at the open end 35 of connector tip portion 32. Such is shown in FIG. 4 which signals the user that the installation is complete and that no further rotation of device 20 is necessary or desirable. At this time, reverse rotation of device 20 releases connector body 27 from device by the interaction of threads 36 and 44. Connector body 27 thus remains attached to the end of cable 22 and the soldering operations may take place at hole 34 and tip open end 35. Then shell 26 may be threaded onto connector body 27 by the interaction of threads 37 and threads 36 to provide the finished product as shown in FIG. 5.

FIGS. 6-10 show a connector installation device, generally indicated by the numeral 50, which is modified slightly from device 20, to accommodate the body of a different type of connector known as a Type N connector and generally indicated by the numeral 51. Device 50 is thus utilized, much like device 20, to attach connector body 51 to a cable 22 having a central wire 23, a wire sheath 24 insulated from and surrounding wire 23, and a casing 25 covering the sheath 24. Connector body 51 is hollow and includes a generally cylindrical base portion 52 of an internal diameter approximately the external diameter of cable casing 25; a cylindrical intermediate portion 53 communicating with the base portion 52 and having an internal diameter approximately the external diameter of the cable sheath 24; and a cylindrical tip portion 54 communicating with the intermediate portion 53 and having an internal diameter approximately the external diameter of the cable central wire 23. A pointed connector end 55 extends forwardly from the end of tip portion 54. The front face (not shown) of intermediate portion 53 is provided with a dielectric seal extending from the outer surface of tip portion 54 to the inside surface of intermediate portion 53. It is important that this seal not be broken as could often happen if connector body 51 were over tightened onto cable 22 by methods of the prior art.

The base portion 52 is provided with internal threads 59 which, as will hereinafter be described in more detail, are adapted engage cable casing 25. Intermediate portion 53 is provided with a hole 60 so that when cable sheath 24 is positioned therein, sheath 24 may be soldered to connector body 51. Similarly, tip portion 54 is provided with an opening 61 so that the cable wire 23 positioned in tip portion 54 may be soldered to tip portion 54.

Figure 10:
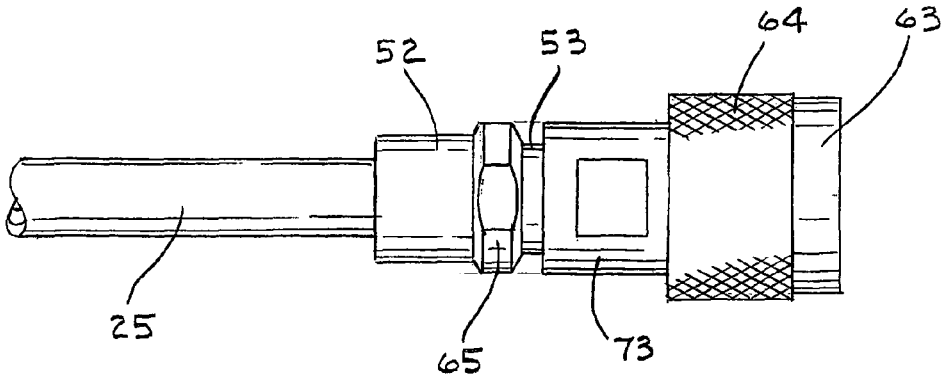
FIG. 10 is an elevational view of the different connector on the cable.

The end of intermediate portion 53 adjacent to tip portion 54 is provided with external threads 62 so that a connector shell 63 having a textured outer surface 64 may eventually be attached to connector body 51 as shown in FIG. 10. A collar 65 is typically provided generally at the junction of base portion 52 and intermediate portion 53. In a conventional connector such as connector 51, collar 65 could be gripped and connector body 51 turned to allow the threads 59 of base portion 52 to cut threads into the cable casing 25 to attach the connector body 51 to the casing 25. However, the use of collar 65 for that purpose is no longer necessary in view of device 50 now to be described.

Like connector installation device 20, device 50 can be made of a metallic material and is formed with a body having a generally cylindrical outer surface 66 at least a portion 67 of which may be textured for ease of gripping. The body of device 50 is provided with a generally axially extending bore therethrough having a section of a first diameter 68, a section of a second diameter 69, and a section of a third diameter 70. A stop shoulder 71 is provided between bore sections 68 and 69, and bore section 69 is internally threaded, as at 72.

Figure 8:
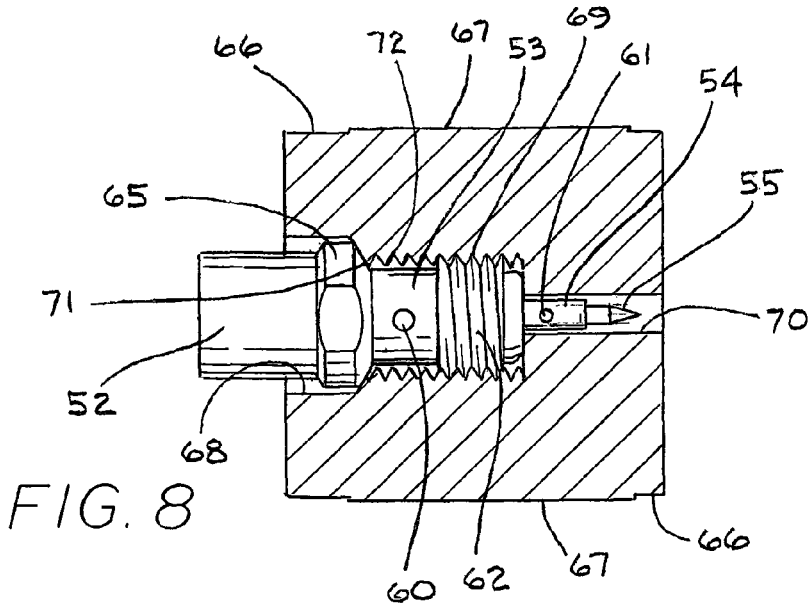
FIG. 8 is a view like FIG. 7 showing the different connector in the modified device.

Installation device 50 is used very simply to attach connector body 51 to an end of cable 22. To that end, either with or without cable 22 being received in connector body 51, connector body 51 is inserted into the bore of device 50 and is attached thereto by the engagement of threads 62 and 72 via a relative rotation of device 50 and body 51. As shown in FIG. 8, body 51 is threaded into the bore until collar 65 engages stop shoulder 71. Unlike device 20 and connector body 27, when in this position the sharp or pointed end 55 is positioned within bore section 70 but, for safety purposes, does not extend out of bore section 70. Nevertheless, its proper presence in bore section 70 can be visually ascertained.

Figure 9:
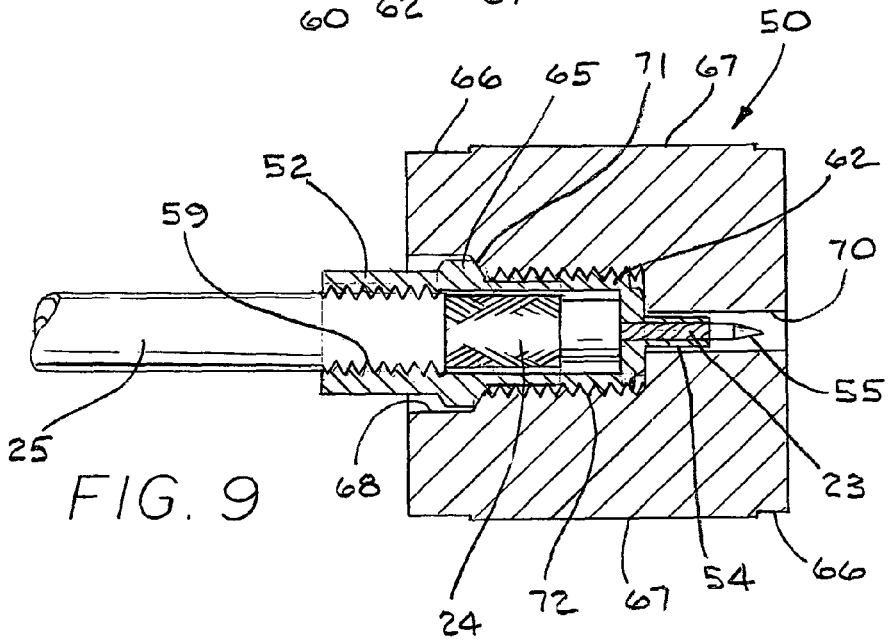
FIG. 9 is a view like FIG. 8 but showing the different connector in section and attached to the cable.

With connector body 51 positioned as shown in FIG. 8, the textured portion of the body of installation device 50 is preferably gripped by the user and if the end of cable 22 has not already been inserted into the mouth of the hollow base portion 52 of body 51, it is so inserted. Then, while holding cable 22 steady, device 50 is rotated while urging it toward cable 22. As such, the threads 59 of base portion 52 cut threads into, and thus engage, casing 25 of cable 22. Rotation continues until the connector body 51 is fully engaging cable 22, as shown in FIG. 9. At this time, reverse rotation of device 50 releases connector body 51 from device by the interaction of threads 62 and 72. Connector body 51 thus remains attached to the end of cable 22 and the soldering operations may take place at hole 60 and opening 61. Then shell 63 may be threaded into connector body 51 by the interaction of the threads 62 with threads (not shown) on the interior of a sleeve portion 73 of shell 63 to provide the finished product as shown in FIG. 10.

In view of the foregoing, it should be evident that connector installation devices constructed as described herein can be used to easily attach a connector to the end of a cable to accomplish the objects of the present invention and otherwise substantially improve the art.

What is claimed is:

1. A method of attaching a coaxial connector to a coaxial cable using an installation device, the coaxial cable including a casing, a wire sheath, an insulating material and a center conductor;

the coaxial connector including a first end including internal threads configured to engage the coaxial cable casing, a second end including a hollow tip portion configured to receive the center conductor, external threads on an outer surface of an intermediate portion of the coaxial connector, and a solder hole associated with the intermediate portion configured to provide a solder path to electrically connect the intermediate portion to the wire sheath; and the installation device including a bore with a first open end diameter and length including internal threads configured to engage the coaxial connector external threads, an internal stop surface configured to engage a face of the coaxial connector to stop the threading of the coaxial connector into the installation device, and a second open end diameter and length configured to receive the coaxial connection hollow tip portion without contacting the coaxial connection hollow tip portion, the method comprising:

A) preparing the coaxial cable to expose a first length of the center conductor, and expose a second length of the wire sheath;

B) threading the coaxial connector external threads into the internal threads of the installation device until the face of the coaxial connector engages the installation device internal stop surface and the coaxial connector hollow tip portion is viewably centered in the second open end of the installation device bore without any contact with the second open end;

C) feeding the coaxial cable center conductor and wire sheath into the coaxial connector first end until the coaxial cable casing engages the coaxial connector internal threads;

D) turning the installation device to thread the coaxial connector internal threads onto the coaxial cable casing, the coaxial connector internal threads cutting threads into the coaxial cable casing; and E) unthreading the coaxial connector external threads from the internal threads of the installation device to remove the installation device from the coaxial connector.

2. The method of claim 1 wherein the coaxial connector includes a tip portion having an open end, and step D allows the tip portion to come out of the second open end of the bore of the installation device.

3. The method of claim 2 wherein step D is completed when the center conductor appears at the open end of the coaxial connector tip portion.

4. The method of claim 3 further comprising a step of soldering the center conductor to the coaxial connector.

5. The method of claim 1 wherein step D is completed before the tip portion comes out of the second open end of the bore.

6. A method of attaching a coaxial connector to a coaxial cable using an installation device, the coaxial cable including a casing, a wire sheath, an insulating material and a center conductor;

the coaxial connector including a first end including internal threads configured to engage the coaxial cable casing, a second end including a hollow tip portion configured to receive the center conductor, external threads on an outer surface of an intermediate portion of the coaxial connector, and a solder hole associated with the intermediate portion configured to provide a solder path to electrically connect the intermediate portion to the wire sheath; and the installation device including a bore with a first open end diameter and length including internal threads configured to engage the coaxial connector external threads, an internal stop surface configured to engage a face of the coaxial connector to stop the threading of the coaxial connector into the installation device, and a second open end diameter and length configured to receive the coaxial connection hollow tip portion without contacting the coaxial connection hollow tip portion, the method comprising:

A) preparing the coaxial cable to expose a first length of the center conductor, and expose a second length of the wire sheath;

B) feeding the coaxial cable center conductor and wire sheath into the coaxial connector first end until the coaxial cable casing engages the coaxial connector internal threads;

C) threading the coaxial connector external threads into the internal threads of the installation device until the face of the coaxial connector engages the installation device internal stop surface and the coaxial connector hollow tip portion is viewably centered in the second open end of the installation device bore without any contact with the second open end;

D) turning the installation device to thread the coaxial connector internal threads onto the coaxial cable casing, the coaxial connector internal threads cutting threads into the coaxial cable casing; and E) unthreading the coaxial connector external threads from the internal threads of the installation device to remove the installation device from the coaxial connector.

7. The method of claim 6 wherein the coaxial connector includes a tip portion having an open end, and step D) allows the tip portion to come out of the second open end of the bore of the installation device.

8. The method of claim 7 wherein step D) is completed when the center conductor appears at the open end of the coaxial connector tip portion.

9. The method of claim 8 further comprising a step of soldering the center conductor to the coaxial connector.

10. The method of claim 6 wherein step D) is completed before the tip portion comes out of the second open end of the bore.

* * * * *